US010526749B2

(12) United States Patent
Milton et al.

(10) Patent No.: US 10,526,749 B2
(45) Date of Patent: Jan. 7, 2020

(54) SYNTHETIC FILL MATERIALS HAVING COMPOSITE FIBER STRUCTURES

(71) Applicant: The North Face Apparel Corp., Wilmington, DE (US)

(72) Inventors: Andrew Milton, Histon (GB); Robert Moir, Cambridge (GB); Michael Murphy, London (GB); Krystle Moody, Sausalito, CA (US); Justin Lee Gladish, Portland, OR (US)

(73) Assignee: The North Face Apparel Corp., Wilmington, DE (US)

( * ) Notice: Subject to any disclaimer, the term of this patent is extended or adjusted under 35 U.S.C. 154(b) by 346 days.

(21) Appl. No.: 15/127,689

(22) PCT Filed: Mar. 30, 2015

(86) PCT No.: PCT/US2015/023371
§ 371 (c)(1),
(2) Date: Sep. 20, 2016

(87) PCT Pub. No.: WO2015/153477
PCT Pub. Date: Oct. 8, 2015

(65) Prior Publication Data

US 2017/0175325 A1 Jun. 22, 2017

Related U.S. Application Data

(60) Provisional application No. 61/991,309, filed on May 9, 2014, provisional application No. 61/973,527, filed on Apr. 1, 2014.

(51) Int. Cl.
*D06M 23/14* (2006.01)
*B68G 1/00* (2006.01)
(Continued)

(52) U.S. Cl.
CPC ..... *D06M 23/14* (2013.01); *A41D 3/00* (2013.01); *B68G 1/00* (2013.01); *D01D 5/0084* (2013.01);
(Continued)

(58) Field of Classification Search
CPC ..... D06M 23/14
See application file for complete search history.

(56) References Cited

U.S. PATENT DOCUMENTS 5,298,321 A * 3/1994 Isoda ..... D02G 1/14 428/362
5,379,501 A 1/1995 Goineau
(Continued)

FOREIGN PATENT DOCUMENTS

CN 103097280 5/2013
EP 0620185 10/1994
(Continued)

OTHER PUBLICATIONS

Machine translation for JPS63-196732. (Year: 1988).*
(Continued)

*Primary Examiner* — Peter Y Choi
(74) *Attorney, Agent, or Firm* — Ganz Pollard, LLC

(57) ABSTRACT

In some embodiments, the inventive subject matter relates to a fiber construct suitable for use as a fill material for insulation or padding, comprising: a primary fiber structure comprising a predetermined length of fiber; a secondary fiber structure, the secondary fiber structure comprising a plurality of relatively short loops spaced along a length of the primary fiber. In some embodiments, the inventive subject matter relates to insulative fiber structures that mimic the structure and scale of natural down and thereby provide similar properties.

24 Claims, 10 Drawing Sheets

(51) Int. Cl.

| | |
|---|---|
| ***D01D 5/00*** | (2006.01) |
| ***D01D 5/08*** | (2006.01) |
| ***D01D 5/098*** | (2006.01) |
| ***D01D 5/18*** | (2006.01) |
| ***D01D 5/28*** | (2006.01) |
| ***D01D 11/06*** | (2006.01) |
| ***A41D 3/00*** | (2006.01) |

(52) U.S. Cl.

CPC ..... *D01D 5/0092* (2013.01); *D01D 5/082* (2013.01); *D01D 5/0985* (2013.01); *D01D 5/18* (2013.01); *D01D 5/28* (2013.01); *D01D 11/06* (2013.01); *A41D 2400/10* (2013.01); *B68G 2001/005* (2013.01)

(56) References Cited

U.S. PATENT DOCUMENTS

| | | | | |
|---|---|---|---|---|
| 5,531,951 | A | 7/1996 | Travelute et al. | |
| 2009/0019614 | A1 | 1/2009 | Hagihara et al. | |
| 2013/0136892 | A1* | 5/2013 | Ozawa ..... | A47C 27/12 428/114 |

FOREIGN PATENT DOCUMENTS

| | | | |
|---|---|---|---|
| EP | 0921220 | | 12/1998 |
| JP | S58198368 | | 11/1983 |
| JP | S62-4239 | * | 1/1987 |
| JP | 63196732 A | * | 8/1988 |
| JP | 2009052183 | | 3/2009 |

OTHER PUBLICATIONS

Machine translation for JPS62-4239. (Year: 1987).*

Office Action in Taiwanese Application No. 104110435, dated Apr. 18, 2017, 10 pages.

Extended European Search Report for European Application No. 157743268.7, dated Oct. 5, 2017, 7 pages.

First Office Action and English Translation for Chinese Application No. 2015800216140, dated Aug. 2, 2017, 19 pages.

Chinese Office Action, Chinese Application No. 2015800216140, dated Jun. 21, 2018, with machine translation into English, the office action and translation totaling 25 pages.

Fourth Chinese Office Action with English Summary for Chinese Application No. 2015800216140, dated Jun. 13, 2019, 17 pages.

* cited by examiner

36

SYNTHETIC FILL MATERIALS HAVING COMPOSITE FIBER STRUCTURES

RELATED APPLICATIONS

This application claims the benefit of and priority to U.S. Provisional Application Ser. No. 61/973,527, filed Apr. 1, 2014 and U.S. Provisional Application Ser. No. 61/991,309, filed May 9, 2014, the contents of which are hereby incorporated by reference as if recited in full herein for all purposes.

BACKGROUND

The inventive subject matter disclosed herein generally relates to units of small scale fibers suitable as fill materials in apparel items, sleeping bags, bedding, pillows, upholstery, cushions, and other such articles and uses. In some embodiments, the inventive subject matter relates to a fiber construct suitable for use as a fill material for insulation or padding, comprising: a primary fiber structure comprising a predetermined length of fiber; a secondary fiber structure, the secondary fiber structure comprising a plurality of short loops spaced along a length of the primary fiber. In some embodiments, the inventive subject matter relates to insulative fiber structures that mimic the structure and scale of natural down and thereby provide similar properties.

Various kinds of natural or synthetic filling material are known. Natural down, e.g. from waterfowl, is an excellent filling material having a number of outstanding properties. Down is the plumage that forms the undercoating of waterfowl (e.g., goose, duck or swan). It consists of tufts of light, fluffy filaments growing from one quill point, but without any quill shaft.

Among down's important physical properties is its loft, also known as fill power. Loft or fill is the volume occupied by a given unit of mass of material. Fill power is the most common parameter used to distinguish between different grades of goose down used in consumer products. A material with a higher fill power is able to occupy a greater volume with a smaller mass and in turn offers greater insulating capabilities. Because fill power has a strong influence on product value, strict guidelines and testing procedures exist to ensure that product labeling and performance concur. The International Down and Feather Laboratory (IDFL) conducts much of the testing and ranking of raw down materials imported from around the world for sale in the United States. A piston-cylinder system is used to determine the fill power. The exact specifications and procedures for this test are available at the IDFL website (IDFL 2004). There are different standards for testing around the world; however, the interpretation and testing principles remain unchanged. For purposes of this patent specification, The International Down and Feather Bureau (IDFB) establishes testing methods and other standards for the international community, and all the IDFB standards and definitions as of Jan. 1, 2014, shall apply to this specification unless otherwise indicated herein.

(The standards and definitions are publicly accessible at the IDFB website, http://www.idfl.com/.)

The properties of down that make it so popular as an insulator are its lightweight, softness, compressibility, recovery power, resilience, and breathability.

Natural feather or down has, however, several disadvantages. For example, many steps are required for processing natural feather or down, since it is highly susceptible to damage by insects and microorganisms. Natural feather and down is also expensive, since it is available only in limited quantities. The handling and care of production animals may also raise animal welfare concerns. Further, down or feathers may induce an allergic reaction in some users. In wet conditions, down can become saturated with water. When this happens down loses its loft, compresses, and hence loses the great insulative properties because down is no longer able to trap air spaces for warmth. Because of this synthetic alternatives for down are constantly being sought. This and other problems have prompted research on novel fibrous materials to develop substitutes for natural feather or down.

Some prior art approaches to making down substitutes include various ways of bundling and bonding short fibers; forming fibers into spherical shapes; and flocking fibers by electrode position. In another approach, disclosed in U.S. Pat. No. 7,261,936, a down substitute in the form of fir-tree or dendritic structures is created from a multifilament fiber that is cut into short segments with fusion so that at one end of a unit filaments are fused together and at the other end they are free. In yet another approach, disclosed in EP 0620185, a down substitute has an elongate support structure with a generally dispersed array of discrete fine fibers, one end of the fine fibers being attached to the support structure and the other end of the fibers being free. However, no such prior art material is sufficiently comparable to natural down material in physical properties. The replication of natural down properties has been particularly challenging due to down's complex structure and physical properties.

FIGS. 1A and 1B schematically illustrate the general structure of a natural down cluster 1 (FIG. 1A). Down clusters may range from about 5 mm to about 70 mm in diameter. They have a central node or root with many strands 2 extending outwardly in all directions. The individual strands may be referred to as "primary" structures or fibers 3. A primary structure 3 has many fine structures extending outwardly along its length, which may be referred to as "secondary" structures or fibers 4. The primary structure 3 has a length of 3 mm to 33 mm, with typical lengths of about 14 mm to 20 mm. A natural down primary structure generally has from 50 to 1500 or thereabout secondary fibers 4 radially disposed along its length (FIG. 1B). With a length of 33 mm, and a spacing of 60 μm, gives 550 secondaries, or 1100 if you count each side separately. With a length of 3 mm, and a spacing of 60 μm, gives 50 secondaries, or 100, if you count each side separately. Natural down may also have one or two relatively short tertiary fibers (not shown) spaced along the length of and extending from each secondary fiber 4 per every 100 microns or thereabout.

Natural down's secondary structure lengths, which are indicated by "D" in the figures, generally, may range between 0.35 mm to 1.4 mm, with lengths of 0.55 mm to 0.75 mm being typical. The secondary fibers are highly resilient and resistant to permanent deformation, and they are capable of storing elastic energy. FIGS. 1A and 1B show representative dimensions of fibers, which can vary in nature.

In addition to the inherent challenges in replicating the physical structure of down, down substitutes are considered difficult to manufacture continuously at a low cost.

In view of the foregoing needs and disadvantages, there is a significant need for improved fill materials, particularly insulative materials that more closely replicate the properties of natural down and which are commercially feasible to produce.

SUMMARY

The inventive subject matter disclosed herein overcomes the foregoing and other disadvantages in the prior art. The advantages of the inventive subject matter over natural down or attempted synthetic down, may include, without limitation, any one or more of the following: lower production cost, water resistance, avoidance of animal welfare concerns, improved thermal retention properties, improved lofting or relofting, improved feel, which better mimics the feel of natural down.

In some embodiments, the inventive subject matter relates to a fiber construct suitable for use as a fill material for insulation or padding, comprising: a primary fiber structure comprising a predetermined length of fiber; a secondary fiber structure, the secondary fiber structure comprising a plurality of relatively short loops spaced along a length of the primary fiber. In some embodiments, the inventive subject matter relates to insulative fiber structures that mimic the structure and scale of natural down and thereby provide similar properties.

The insulating materials may be used in a variety of applications where insulation and/or padding are needed, including garments and apparel, sleeping bags, blankets, upholstery, etc.

The inventive subject matter is also directed to related processes, systems and apparatus for making the inventive fiber constructs.

These and other embodiments are described in more detail in the following detailed descriptions and the figures.

The following is a description of various inventive lines under the inventive subject matter. The appended claims, as originally filed in this document, or as subsequently amended, are hereby incorporated into this Summary section as if written directly in.

The foregoing is not intended to be an exhaustive list of embodiments and features of the inventive subject matter. Persons skilled in the art are capable of appreciating other embodiments and features from the following detailed description in conjunction with the drawings.

BRIEF DESCRIPTION OF THE DRAWINGS

The appended figures show embodiments according to the inventive subject matter, unless indicated as showing prior art.

DETAILED DESCRIPTION

Figure 1A:
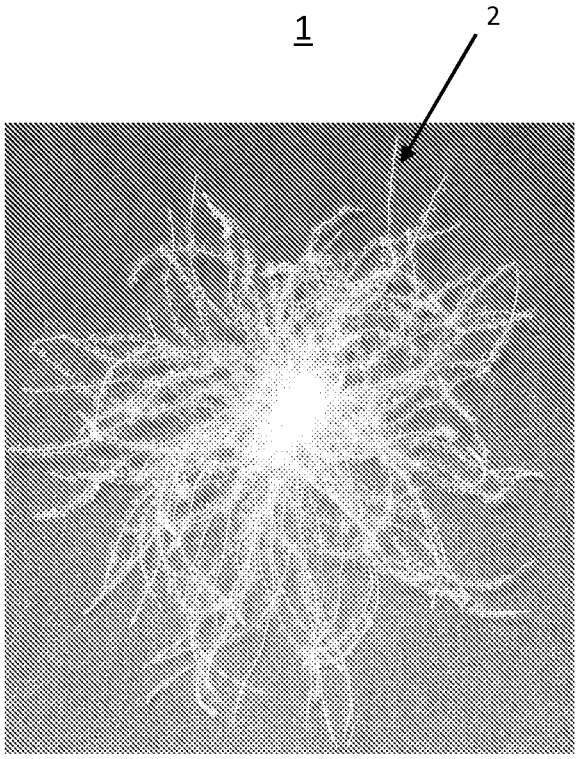
FIG. 1A is illustrates a representative natural down cluster.

Representative embodiments according to the inventive subject matter are shown in FIGS. 2-17, wherein the same or generally similar features share common reference numerals.

The inventive subject matter is generally directed to novel structures, collections of the structures and methods of producing the structures for use as fill material for insulation or other bulk material applications, such as padding or cushioning. The materials may be used as a substitute for down with many advantages over down.

According to the inventive subject matter, the fill material consists of constructs of a composite 10 of a primary fiber 12 and a plurality of coupled secondary fibers 14 that are arranged in a plurality of two- or three-dimensional loops along the length of the primary fiber.

"Fiber", as used herein, is a general term that may mean lengthy filaments in the meter range, short fibers of centimeter or millimeter scale, or fibrils in the micron or nanoscale. Fibers may be monofilaments or a bundle of filaments.

As used herein, "superfine" fibers means fibers having an average diameter (or other major cross-sectional dimension in the case of non-circular fibers) in the micron scale to nanoscale. As used herein, "micron scale" means the fibers have average diameters in the range of double or single-digit microns to as low as about 1000 nanometers. In the textile industry, nanoscale fibers have average diameters in the range of about 100-1000 nanometers or less). In certain embodiments, superfine fibers exhibit a high aspect ratio (length/diameter) of at least 100 or higher. Superfine fibers may be analyzed via any means known to those of skill in the art. For example, Scanning Electron Microscopy (SEM) may be used to measure dimensions of a given fiber.

All dimensions are averages for the indicated item and/or, if reference is to more than one item, to the set of items, unless context indicates otherwise. For example, the diameter of the secondary fiber 14 is the average diameter taken from one end point to another, or from one intersection point 14B to opposite intersection point 14C on the same loop 16. The diameter of a plurality of loops of secondary fiber is determined by first determining the average diameter of individual loops in a set of loops and then taking those values and averaging them for the set of loops.

The primary and secondary fibers 12, 14 may be coupled in various ways described and may include direct attachment of primary and secondary fibers, e.g., by selecting a thermoplastic material as a primary and/or secondary fiber material and fusion bonding the fibers together. Alternatively, the fibers may be indirectly coupled using a bonding agent, such as an adhesive.

The novel constructs 10 according to the inventive subject matter may be characterized by a primary fiber 12 that is elongated in form and is a primary structure. The primary structure has disposed along its length a plurality of transversely extending secondary fibers 14 that form secondary structures in the nature of loops 16, with one closed end or maxima 14A of a given loop being defined by a section of the primary fiber that extends transversely from intersection points 14B, 14C of the secondary fiber with primary fiber 12. In certain embodiments, the loops 16 alternate along the length of the primary structure so as to provide a sinusoidal or undulating pattern having positive and negative maximas along a baseline, with the primary structure serving as the baseline. This is seen, for example, in FIGS. 2A and 2B and FIG. 3A.

In certain possible embodiments, the loops 16 are formed in a pattern of loops by disposing a continuous length 114 of secondary fiber in a desired pattern, such as a sinusoidal or undulating pattern, on a predetermined length 112 of the primary fiber. Methods for producing such structures are discussed in more detail below. As the secondary fiber 114 forms a series of loops 16, rather than a set of discrete, linear branches, as in the prior art, the looping creates a bulkier surface that helps keep the primary fibers apart. It is believed that the loops provide analogous function to the tertiary hooks of natural down, allowing for a synthetic down that is closer to natural down. Accordingly, a key advantage contemplated by the inventive subject matter is improved loft.

Figure 2A:
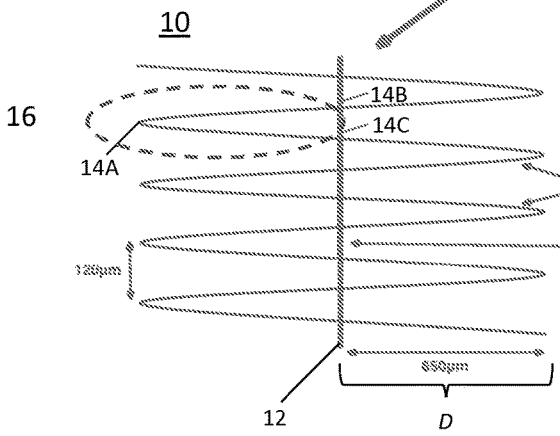
FIG. 2A schematically illustrates one possible synthetic construct of a primary fiber and associated secondary fibers that mimics a natural down cluster.
Figure 2B:
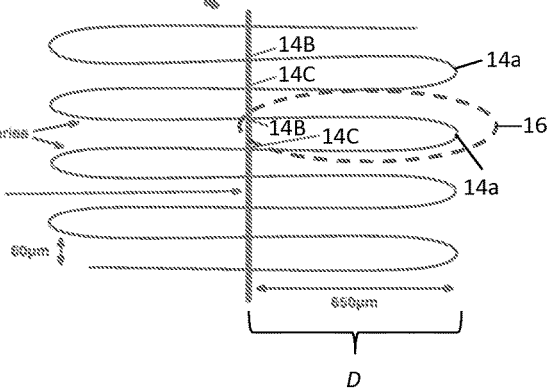
FIG. 2B schematically illustrates a synthetic construct with an alternative arrangement of primary and secondary fibers that mimics a natural down cluster.
Figure 2C:
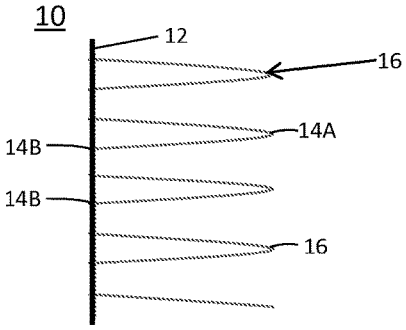
FIG. 2C schematically illustrates a synthetic construct with another alternative arrangement of primary and secondary fibers that mimics a natural down cluster.
Figure 3:
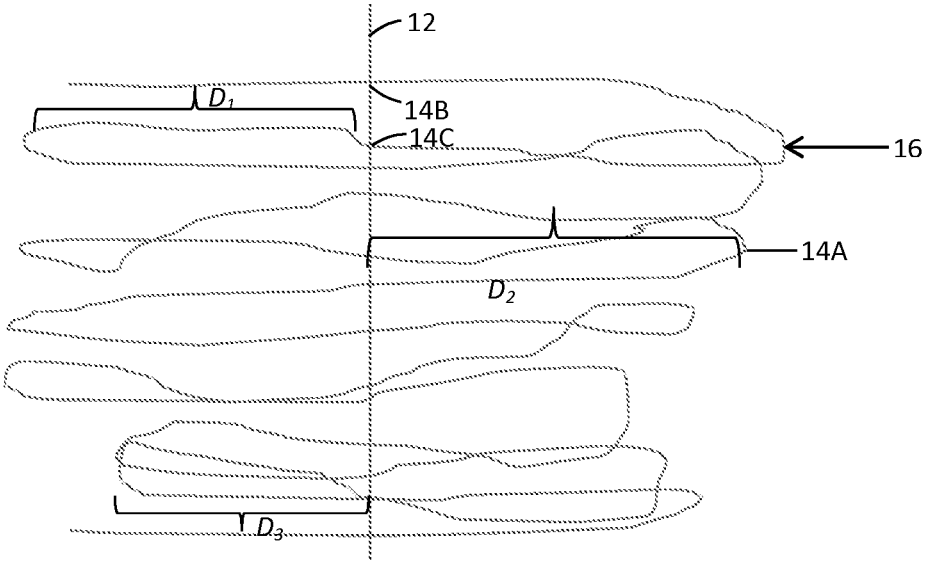
FIG. 3 schematically illustrates a synthetic construct with yet another alternative arrangement of primary and secondary fibers that mimics a natural down cluster.

In some embodiments the loops of the secondary fiber may be oriented entirely or preferentially along one side of the primary structure. An example is seen in FIG. 2C.

The primary and secondary structure can be of the same material or different materials. In some embodiments, the primary fibers have higher stiffness, tensile strength and/or higher thickness relative to the secondary fibers.

The loops 16 in the secondary structures are not limited to any particular shape or geometry. For example, they may be elliptical semi-circles, polygonal, complex curve, or any other closed-loop form with end points emanating on the primary structure. Any given loop 16 may have a symmetrical, uniform, asymmetric or irregular shape. The size and/or spacing of the closed loops can be uniform or non uniform along the primary structure. The arrangement of secondary structures can be two-dimensional or three-dimensional shapes around the primary structure. The amplitude or length D of the loops, as measured perpendicularly from the primary fiber from on or between intersections 14B, 14C to a maxima 14A may be uniform for each loop along the length of the primary structure or it may vary from loop to loop, as indicated by $D_1$, $D_2$, $D_3$, where in each $D_1$, $D_2$ and $D_3$are all different values.

The following figures (FIGS. 4 to 9) are top and/or side views looking down the longitudinal axis of a composite primary/secondary fiber structure 10, which conceptually illustrate a range of possible configurations for the composite structure.

Figure 4:
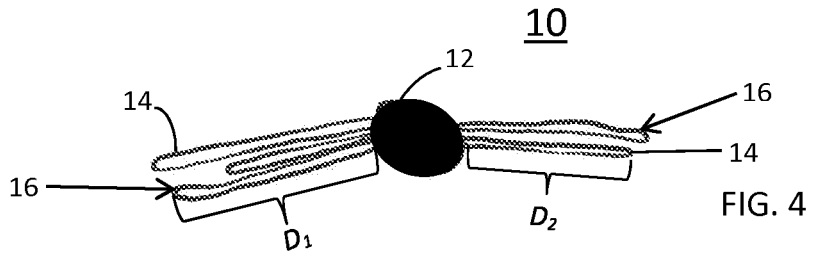
FIG. 4 schematically illustrates an embodiment of a synthetic construct where loops of secondary fibers protrude in two main directions or planes from the primary fiber.

FIG. 4 shows an example where loops 16 of secondary fibers, may protrude in two main directions or planes from the primary fiber 12.

Figure 5:
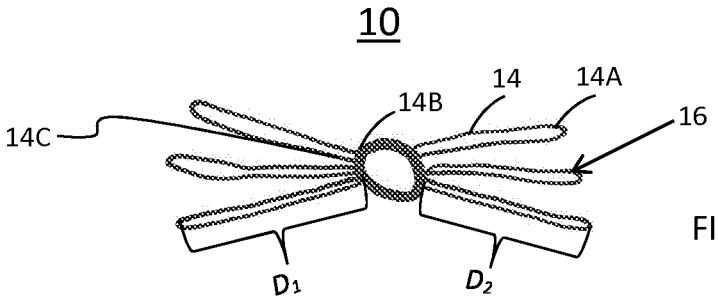
FIG. 5 schematically shows an alternative embodiment of a synthetic construct where secondary fibers are twisted or helically arranged around the primary fiber.

FIG. 5 shows an alternative embodiment where a twist in the primary fiber 12 (or spiraling of the secondary fiber around the primary fiber) may cause the secondary fibers to form a twisted or helical structure (where the angle of protrusion of the secondary fibers varies linearly with it is position along the z-axis of the primary fiber).

Figure 6:
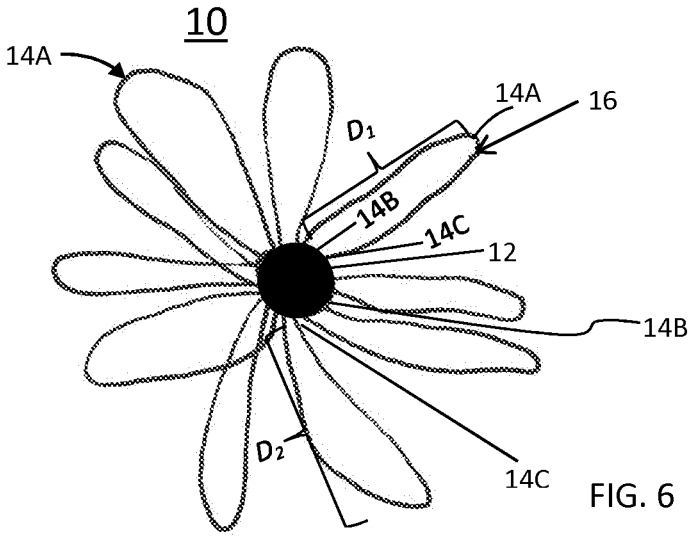
FIG. 6 schematically illustrates an alternative embodiment of a synthetic construct where the loops of secondary fibers could protrude randomly in all directions from the primary fiber.

FIG. 6 shows an alternative embodiment where the loops 16 of secondary fibers could protrude randomly in all directions from the primary fiber.

Figure 7:
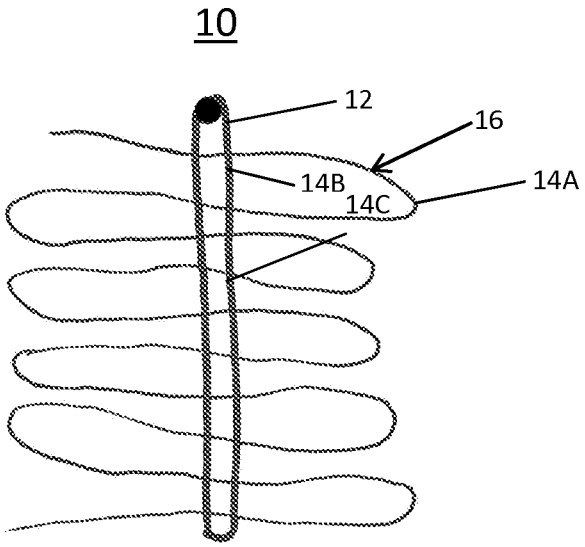
FIG. 7 schematically illustrates an alternative embodiment of a synthetic construct where the loops of secondary fiber are arranged in a neat or uniform pattern.

FIG. 7 shows an alternative embodiment where the loops 16 of secondary fiber could be arranged in a neat or uniform pattern.

Figure 8:
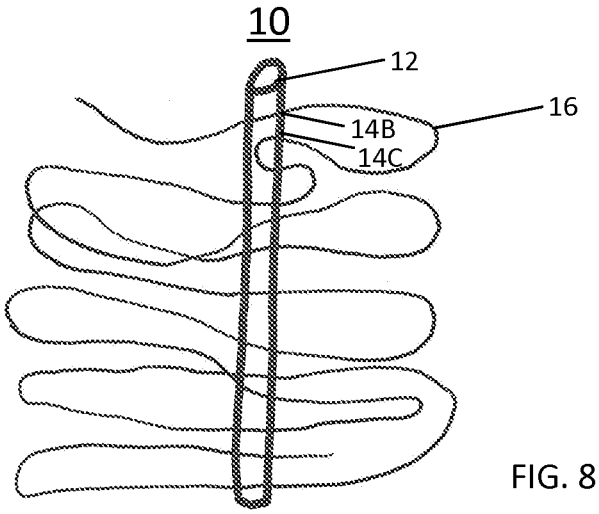
FIG. 8 schematically illustrates an alternative embodiment of a synthetic construct with a less than neat or non-uniform arrangement.

FIG. 8 shows an alternative embodiment where a less neat or non-uniform arrangement would be suitable.

Figure 9:
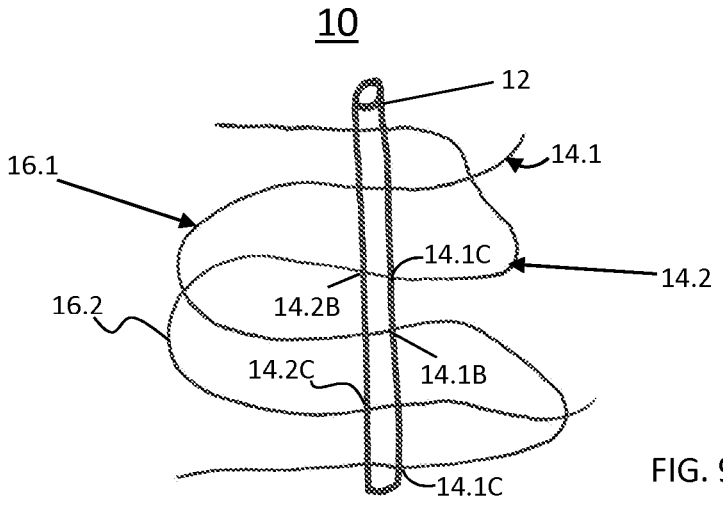
FIG. 9 schematically illustrates an alternative embodiment of a synthetic construct where two or more secondary fibers forming loops are positioned onto a single primary fiber, while maintaining the same or overall ratio, or other desired ratio, of the length of primary to secondary fibers.

FIG. 9 shows an alternative embodiment where two or more secondary fibers 14.1 and 14.2 forming loops 16.1 and 16.2 could be positioned onto a single primary fiber 12, while maintaining the same or overall ratio, or other desired ratio, of the length of primary to secondary fibers.

Figure 10:
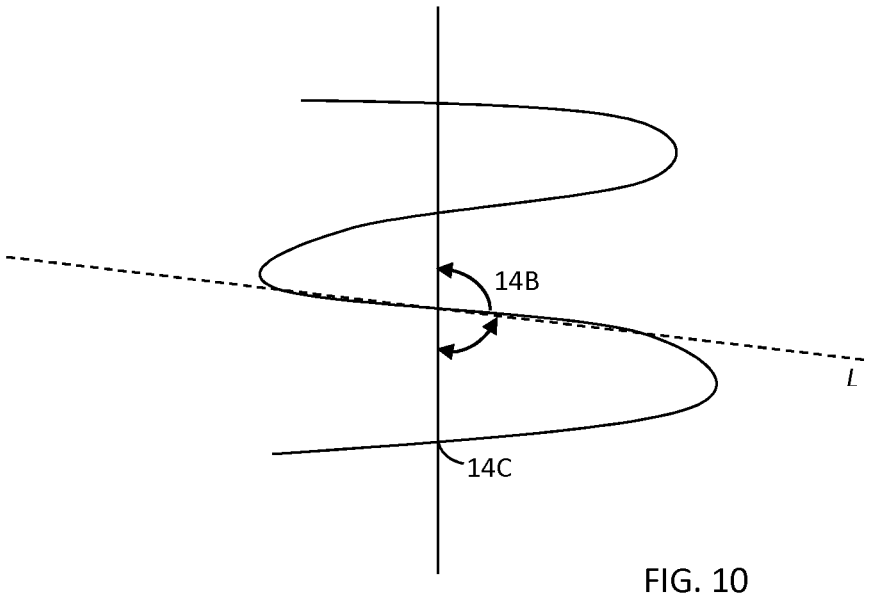
FIG. 10 schematically illustrates an alternative embodiment of a synthetic construct where the secondary fiber portions defined by a line or approximate line L through an intersection point and an outwardly extending leg of the corresponding loop may form a pair of supplementary angles with the primary fiber.

The secondary fiber portions defined by a line or approximate line L through an intersection point 14B or 14C and an outwardly extending leg of the corresponding loop may form a pair of supplementary angles with the primary fiber 12, as seen in FIG. 10. One supplementary angle may be an acute angle that is similar to the angle of secondary fibers in natural down, which is in the range of 30 degrees to 60 degrees, and more particularly in the range of about 40-45 degrees. The overall loops 16 may also be arranged to have such angling.

In the various embodiments disclosed herein, the primary and secondary structures may have the same or different material or physical properties. They may have the same or different diameters or denier. For example, the primary fiber 12, 112 diameter may typically be greater than the diameter or denier of the secondary fiber. However, diameter is not necessarily dispositive of fiber properties. For example, the primary fiber might have a smaller diameter if it is made of a material that is stronger or stiffer than the material of which the secondary fiber is made.

In some representative embodiments, the primary fibers may have a diameter of from about 10 μm-100 μm. For the primary fibers, diameters equal to or less than about 90 μm, 80 μm, 70 μm, 60 μm, 50 μm, 40 μm, 30 μm, 20 μm, or 15 μm, are contemplated. Diameters of 20-30 μm are expected to mimic those in natural down. For some applications where weight savings is important, by selecting relatively high diameters, the fibers will add unnecessary weight to the insulation. On the other hand, by selecting relatively low diameters, the fiber may not be sufficiently stiff to provide the necessary loft and recovery.

In some representative embodiments, the secondary fibers 14, 114 may have a diameter of 0.5 μm to 100 μm, and more particularly diameters equal to or less than about 100 μm, 90 μm, 80 μm, 70 μm, 60 μm, 50 μm, 40 μm, 30 μm, 20 μm, 15 μm, 12 μm, 11 μm, 10 μm, 9 μm, 8 μm, 7 μm, 6 μm, 5 μm, 4 μm, 3 μm, 2 μm, 1 μm or 0.5 μm are contemplated. Where any fiber has a non-uniform diameter, the diameter may generally be considered the average diameter, taking a statistical sampling of diameters along the fiber length. Diameters of 1 μm-3 μm are expected to mimic those of the secondary structures in natural down. If diameters are below 1-3 μm or thereabout, the fibers may not be as effective at stopping radiant heat loss but we have included nano-sized fiber for the purpose of trapping air space and reducing convective currents. If diameters are above 12 μm or thereabout, the insulation's warmth to weight ratio may be less than optimal. However good commercial insulations have been made with fiber diameters up to 25 μm and higher (e.g., Primaloft™ insulation), so a structure with 25 μm or thereabout fibers may still be suitable in some applications.

The inventive subject matter is not necessarily limited to any given dimensions or ratios of dimensions or other metrics specifically recited, and numbers and values above or below and in between values, limits or ranges may also apply. Denier of the primary or secondary fibers may be 6D or less.

The ratio of the diameters of the primary fiber to the diameter of the secondary fiber (the "aspect ratio") may vary. Suitable ratios include from 1:1 to 100:1 or thereabout. Ratios of 6:1 to 30:1 or thereabout may mimic those of natural down. As noted above, the aspect ratio may also be less than one, particularly if the primary fiber is made from a material of higher strength properties than the material for the secondary fiber.

The thin fiber portions are intended to contribute insulative properties, and the thicker fiber portions contribute resilient structure for loft. Because the two are intimately connected, as in down, re-lofting performance is improved. Loops of the thin, secondary fibers are expected to keep the thicker, primary fibers apart and help prevent irreversible entanglement. In engineering a suitable configuration for units of synthetic down, one consideration, which may be empirically addressed, is making the secondary fiber structure sturdy enough that it is not too fragile to effectively exclude space for trapping air.

Forming Secondary Fiber Configurations onto Supporting, Primary Fibers

Units of fiber constructs according to the inventive subject matter described herein may be produced using various methods. Each construct consists of a composite of a primary fibers and a coupled secondary fiber that is arranged in a plurality of two- or three-dimensional loops along the length of the primary fiber. Typically the composite fibers are monolithic structures formed by fusing of the materials for the primary and secondary fibers. As noted above, the primary and secondary fibers may have diameters of less than one millimeter to the nanoscale.

The inventive subject matter contemplates novel production methods generally based on positioning of a melted, softened or solid secondary fiber material 114 onto a melted, softened, or solid primary fiber material in a desired pattern that creates the composite fiber structures 10 disclosed and contemplated herein. The patterns may be created by relative movement of a stream of the secondary material over the stream or structure of the primary fiber material. As used herein, "stream" means a filamentous flow of material in any state, e.g., liquid, softened, or solid. An example of a stream material is a moving yarn being pulled to or from a spool. As used herein, "structure" in the context of fibers means a solid-phase filamentous material, which in the processing steps contemplated herein may be dynamic, as in a stream, or static.

Fiber-forming methods that may be adapted for use in creating such relative movement include electrospinning, meltblowing, meltspinning, forcespinning, or other methods of creating a composite fiber structure from a primary fiber 112 and a secondary fiber 114. The secondary fibers may be patterned not only as loops but could also be patterned as linear or curved structures that intersect the primary fiber.

Fibers, such as superfine fibers, may be produced using forced ejection of a selected fiber-forming material through an ejector with a tiny outlet port. For example, a meltblowing processes involves heating and extruding a thermoplastic, fiber-forming polymer through tiny exit ports in a meltblown die head. The molten polymer is then subjected to convergent streams of high velocity gas, such as air, to rapidly attenuate the polymer into small scale, micro scale or super-fine fibers having a diameter less than the diameter of the exit ports in the die head. The gas has a temperature higher than or equal to the temperature of the molten polymer and is blown against the molten polymer in the direction of flow. In this manner, the high velocity gas also moves the resulting fibers toward a collector. The ambient air-cools and solidifies the molten fibers, which are collected. The meltblowing process may directly transform polymer resins into a filament or fiber in a single, integrated process. In a typical process, polymer is stored in a hopper in the form of beads, pellets, or chips. An extruder shaft or the screw forces the polymer from the feed hopper into the melting section. The polymer is then exposed to incrementally increasing temperatures in consecutive heating zones in the extruder. As the polymer passes through the extruder, the molten material is heated until it reaches the final desired melt-blowing temperature before being forced through the meltblowing die.

According to one possible embodiment of the inventive subject matter, an extrusion apparatus includes an ejector capable of ejecting a fluid, softened, or solid material. For example, the ejector may be a pair of nozzles or die heads each coupled to a supply source, such as lines feeding a flowable fiber-forming material. The lines, in turn, may be coupled to a supply of thermoplastic material, such as a hopper of such material. One nozzle is coupled to a supply source that contains a material for producing a primary fiber 112. The other nozzle is coupled to the same or a different supply source that contains a material for producing a secondary fiber 114. The system may include a pressurization source such as a compressor or gas to drive the flowable materials through the nozzles or die heads. In some embodiments, the ejector may be a guide or port for a spooled supply of material, such as a spool of yarn or other filamentous material.

Process parameters include varying the nature of the material used to produce each fiber type and varying the shape and dimensions of the exit ports on the nozzles from which the flowable, fiber-forming material is ejected. The exit ports on the nozzles may be associated with ports for a pressurized gas that converges on the stream of material 112 or 114 to attenuate it to a diameter smaller than the diameter of the exit port.

Figure 11:
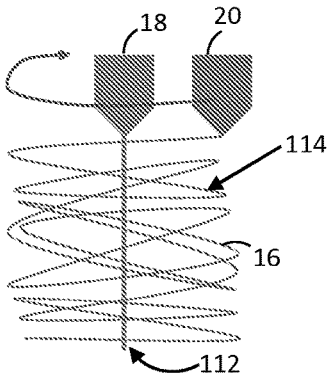
FIG. 11 schematically illustrates components of one possible system for producing fibers for synthetic constructs that mimic natural down.

Referring to FIG. 11, the ejectors, for example a pair of nozzles 18 and 20, are spaced so that they blow or extrude streams of fiber forming material 112, 114 in closely spaced streams. More particularly, the ejectors are arranged to stream their respective fiber materials in generally the same direction, e.g., from parallel (0 degrees) to an angle of intersection of up to 90 degrees so that one stream is capable of converging on the other stream in a back and forth manner or a partially or fully encircling manner. Converging of streams ejected in parallel streams or at more than 90 degrees may still be achieved using directed airflow against one or both streams, as indicated below.

The nozzle 20 for the secondary fiber is rotatable and/or arranged to be relatively rotatable around the nozzle for the primary fiber. As that nozzle rotates, a stream of the secondary fiber-forming material 114 spins around and entangles with the stream of the primary fiber material 112, producing loops 16 of secondary fiber along the length of the primary fiber 112. The spacing of the intersecting points for a loop and size of the loops may be controlled by, for example, changing the angle of the stream of one or both nozzles relative to the stream of the other nozzle, varying the rate of relative rotation, and the spacing of one stream from the other. Other means of control include creating a directed air or other gas flow in the processing area that is applied against fiber material streams 114 or 112, to a melt or softened thermoplastic. Mechanisms for directing airflow include both positive and negative pressure system, e.g., fans, vacuums, and pressurized gas sources. Airflow may be directed at any desired angle against one or both streams so as to redirect the streams and create a desired angle of convergence.

In a variation of the above system, the primary fiber may be a preformed structure and so that a stream of secondary fiber material 114 is spun around it. For example, the nozzle 20 for the secondary fiber forming material 114 could be arranged so that it simultaneously spins and moves up or down along the length of the pre-formed primary fiber 112, creating a spiral of material that entangles with the primary fiber as loops along its length. The primary fiber 112 may be in a streaming or static state.

The secondary fiber-forming material 114 may be a thermoplastic material that fusion bonds to the primary material, which may also be a thermoplastic material. One material may have a different melt or glass transition temperature relative to the other, or they may have the same such properties.

Alternatively, a chemical adhesive could be applied to the surface of one or both of the primary fiber 112 or secondary fiber 114 so that the two bond together on contact. Similarly, the bonding could be achieved by a curing process using polymer materials that are reactive under specified conditions, such as UV wavelengths of light or ultrasonic energy. An advantage of ultrasonic energy is that it may act on the crossover points 14B and 14C of the primary and secondary structures without adding heat that melts or softens and changes the shape of one or both overall structures. Although the foregoing embodiments may show single nozzles for ejecting streams of secondary fiber-forming material 114, persons skilled in the art will readily appreciate from the teachings herein that multiple nozzles 20 could be used and arranged to rotate around a stream or other structure for a primary fiber 112.

The foregoing description focuses on methods of producing 360 degrees of rotation of a secondary fiber forming material around a primary fiber stream or structure. However, any desired degree of rotation may be used. For example, a nozzle 20 for the secondary fiber stream could be rotated at 45, 90, 180, or 270 degrees relative to primary fiber's stream or structure so that loops 16 form preferentially on one side of the primary structure.

Figure 13:
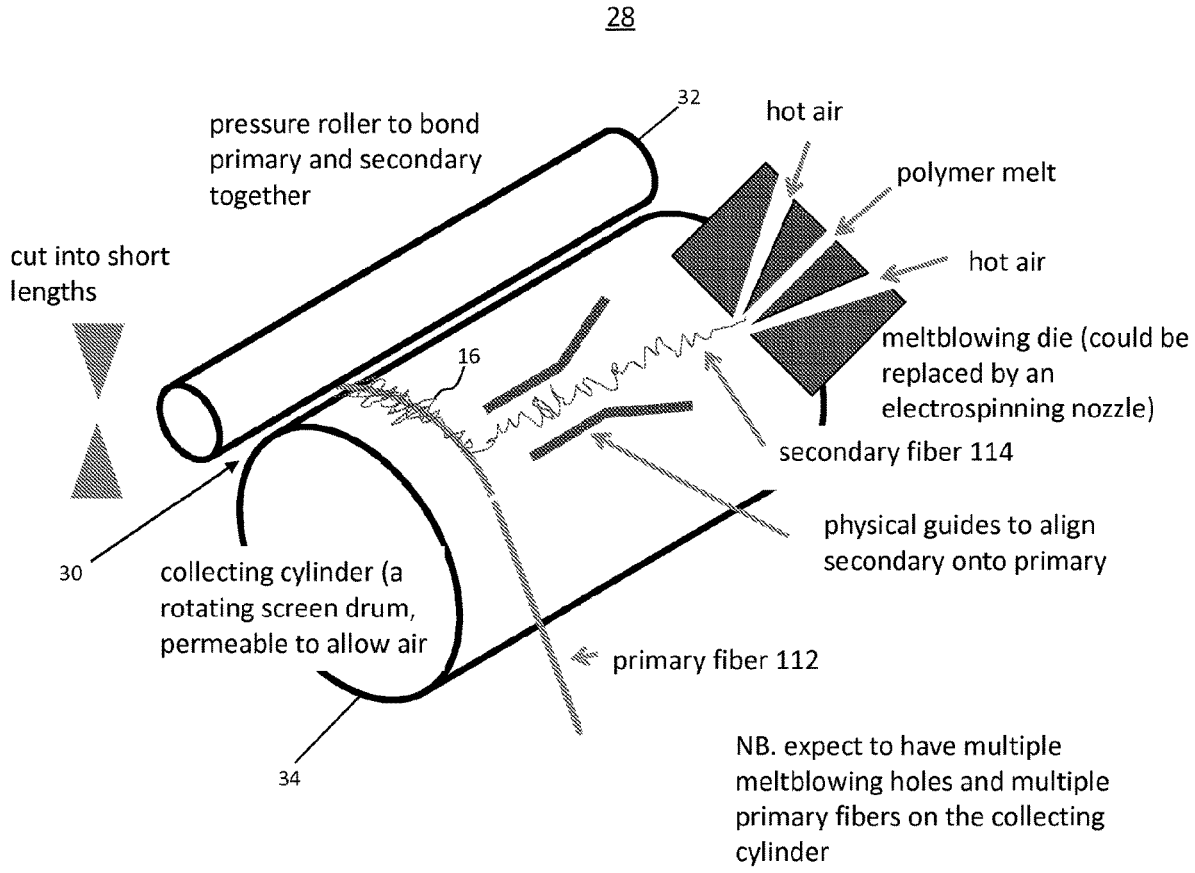
FIG. 13 schematically illustrates components of an alternative embodiment of a system for producing fibers for synthetic constructs that mimic natural down.

Another approach for creating a two-dimensional fiber is to direct a stream or structure 114 of secondary fiber material back and forth along a length of a stream or structure 112 for the primary structure, creating a two-dimensional generally sinusoidal pattern of loops on one side of the primary fiber, as seen in FIG. 13, for example.

Another approach for creating full or partial encircling of secondary fibers spaced along and fully or partially around the primary fiber could be achieved by resiliently twisting the primary fiber before or during the application of the secondary fiber so that the secondary fiber becomes disposed along different points on the circumference of the primary fiber. By using a resilient primary fiber material, the fiber untwists so that the secondary fibers are arranged in such a manner. In this method, the secondary fiber material needs to be applied only along one side of the primary fiber; no rotation of the ejector for the secondary fiber material is needed, only relative movement up or down the secondary fiber material along the length of the primary fiber material. The movement can also be back and forth across the primary fiber material. In any case, the movement is limited to a single plane.

Figure 12:
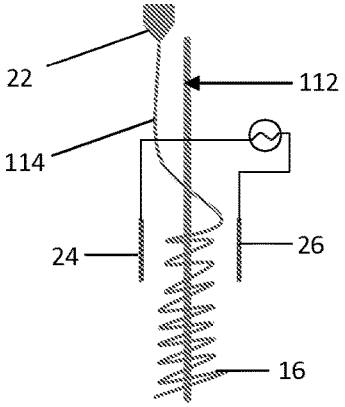
FIG. 12 schematically illustrates components of an alternative embodiment of a system for producing fibers for synthetic constructs that mimic natural down.

Referring to FIG. 12, in another possible embodiment, the path and nature of the engagement of the secondary fiber to the primary fiber is controlled by electrostatic forces in a modified electrospinning process. The typical system includes: a high-voltage source connected to a syringe or needle, which is coupled to a source of a fluid fiber-forming 114 material. An electrical field is created so as to charge the needle or syringe at a nozzle portion with one or more ports from which a fluid exits. Electrodes for focusing, steering, and guiding the exiting solutions are positioned below the needle or syringe. The electrodes help guide/draw the fluid into what may be a microscale or nanoscale fiber from nozzle and onto a collector, which may be a static element such as a tray, or it may be a dynamic element such as continuously moving belt or roller.

According to the inventive subject matter, a stream of secondary material 114 from ejector 22 is subjected to an alternating electrostatic field from electrodes 24, 26 so that the stream spirals around and entangles with a primary fiber stream or structure 112. Another approach could be to extrude a stream within the electrostatic field on top of the primary fiber stream in a sinusoidal fashion. The desired properties and dimensions of the fibers may be controlled using a variety of known parameters for electrospinning. These parameters include: electrical charge of the spinning material and the spinning material solution; solution delivery (often a stream of material ejected from a syringe); charge at the stream; electrical discharge of the filaments at the collector; external forces from the electrical field on a dynamic stream (e.g., spinning, rotating, undulating) or stationary stream; density of expelled stream; and voltage of the electrodes and geometry and any dynamics of the collector. Persons skilled in the art will appreciate how such parameters may be empirically used to create the inventive synthetic down disclosed and contemplated herein.

The foregoing embodiments for spinning nozzles and electrospinning may also be combined into one system.

Figure 14:
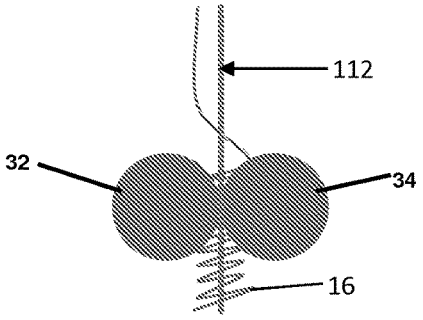
FIG. 14 schematically illustrates components of an alternative embodiment of a system for producing fibers for synthetic constructs that mimic natural down.
Figure 15:
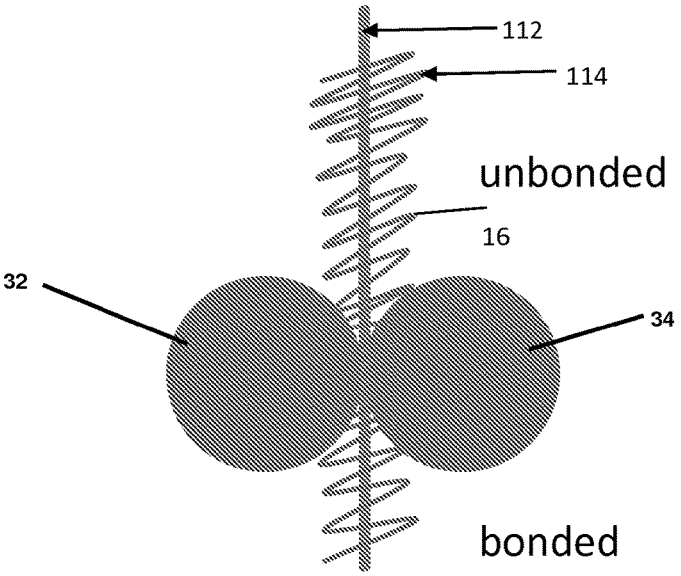
FIG. 15 schematically illustrates components of an alternative embodiment of a system for producing fibers for synthetic constructs that mimic natural down.

In another embodiment of the inventive subject matter, composite constructs of primary and secondary fibers are made using a mechanical system that positions a secondary fiber against primary fiber in a desired pattern, such as those disclosed and contemplated herein. The positioned fibers may be set and coupled into a desired pattern by, for example, compression setting and/or other mechanisms such as those described elsewhere herein. For example, thermal energy or adhesives may be used to couple the fiber portions to one another. FIGS. 13-15 show details of representative mechanical systems according to the foregoing embodiment. In these examples, a filament 112 of primary fiber material being fed into a gap 30 between rollers 32 and 34 that is sufficiently spaced to receive and draw in the primary and secondary fibers in their original dimensions or in a smaller dimension defining a compression of the original dimensions. The primary fiber 112 is fed perpendicularly to the rotational axis of the rollers 32, 34. The secondary fiber 114 is fed onto the primary fiber parallel or otherwise transversely to the primary fiber's longitudinal axis. The secondary fiber may be a stream of fiber in a melted, softened or solid form. The secondary fiber 114 may be fed from any mechanism or system for providing a stream, such as the meltblowing or forcespinning systems discussed elsewhere herein. Similarly, the primary fiber 112 may be provided from such sources. To position the secondary fiber relative to the primary fiber, directed air or other gas, and/or physical guides may be used. For example, a directed airflow may be regulated in bursts so that the secondary filament undulates back and forth across the primary fiber. The combined primary and secondary fibers are drawn through the rollers and set together by compression and/or fusion bonding. The composite structure has a backbone of the primary filament and the outwardly loops formed of the secondary filament. The overall composite structure is generally planar. However, as indicated above, in other embodiments, the primary fiber may be resiliently twisted so the secondary fiber orients around the fiber in multiple planes.

In yet another possible embodiment, stream of fiber material is ejected using forcespinning or meltspinning. Forcespinning is a process to extrude super fine fibers using centrifugal force to elongate the fibers. The outlet port for an ejector is configured with a size and shape to cause a fine stream 112 or 114 of the fluid material to form on exit from the outlet port. As used herein, an outlet port means an exit orifice plus any associated channel or passage feeding the outlet port and serving to define the nature of the expelled stream of fiber-forming material. Due to factors such as surface tension, fluid viscosity, solvent volatility, rotational speed, and others, the ejected material can solidify as a superfine fiber that has a diameter significantly less than the inner diameter of the outlet port. Herein, such expulsion of flowable material from an outlet port as a stream that solidifies as a fiber may be referred to as "stream extrusion". The stream of expelled material is directed to a collector where it is gathered for use in an end product.

In certain embodiments a rotary device imparts centrifugal force on a fiber-forming material to cause stream extrusion and consequently fiber formation. The force that is imparted on the source material may come from various systems and techniques that do not require applied electrical fields, as in electrospinning. For example, U.S. Pat. Nos. 4,937,020, 5,114,631, 6,824,372, 7,655,175, 7,857,608, 8,231,378, 8,425,810, and U.S. Publication No. 20120135448, teach various devices and processes for forced ejection of fiber-forming material through an outlet port on a rotary device. The foregoing collection of patent documents includes disclosures for systems for production of fibers with average diameters in the micron-scale or nanoscale range. The foregoing patent documents are hereby incorporated in their entireties for all purposes. An alternative approach to rotary systems is based on non-rotary pressure feeding of a fiber-forming fluid through an outlet port that creates a stream of the fluid that forms into a fiber. For example, U.S. Pat. No. 6,824,372, which is hereby incorporated by reference in its entirety for all purposes, discloses a chamber that imparts ejection force on a fiber-forming fluid contained therein via oscillating pressure changes that are generated by a movable wall for the chamber.

The processes and equipment for forcespinning are known to persons skilled in the art by virtue of various known teachings, such as some of the patent documents listed above, as well by virtue of commercial equipment suppliers such as FibeRio Technology Corporation, McAllen, Tex., USA, which supplies a line of forcespinning equipment (See http://fiberiotech.com/products/forcespinning-products/). Therefore, a detailed description of forcespinning is unnecessary, and only is a brief description will be provided herein.

Figure 17:
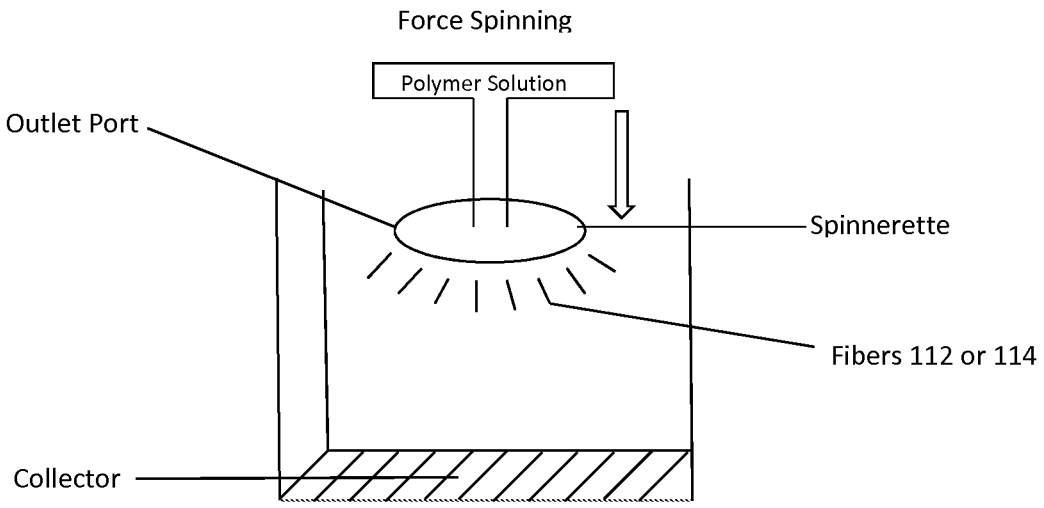
FIG. 17 schematically illustrates components of an alternative embodiment of a system for producing fibers for synthetic constructs that mimic natural down.

Referring to FIG. 17, a forcespinning system is shown for producing fine fibers 112 or 114. The system includes a spinneret that is coupled to a source of fluid or flowable material that is formable into a fiber ('fiber-forming material'). The source of material may be from a supply source, such as a reservoir or hopper for continuously feeding the spinneret. The spinneret could itself include a reservoir or hopper of material that is rotated with the spinneret.

The flowable material could be molten material or a solution of material. The spinneret is mechanically coupled to a motor that rotates the spinneret in a circular motion. In certain embodiments, the rotating element is rotated within a range of about 500 to about 100,000 RPM. In certain embodiments, the rotation during which material is ejected is at least 5,000 RPM. In other embodiments, it is at least 10,000 RPM. In other embodiments, it is at least 25,000 RPM. In other embodiments, it is at least 50,000 RPM. During rotation, a selected material, for example, a polymer melt or polymer solution, is ejected as a stream of material from one or more outlet ports on the spinneret into the surrounding atmosphere. The outward radial centrifugal force stretches the polymer stream as it is projected away from the outlet port, and the stream travels in a curled trajectory due to rotation-dependent inertia. Stretching of the extruded polymer stream is believed to be important in reducing stream diameter over the distance from the nozzle to a collector. The ejected material is expected to solidify into a superfine fiber by the time it reaches a collector. The system includes a collector for collecting the fiber in a desired manner. For example, the fibers could be ejected from the spinneret onto a surface disposed below the spinneret or on a wall across from outlet ports on the spinneret. The collecting surface could be static or movable.

The fiber may be oriented into a linear stream by directional airflow and used in a manner like other streams or structures for primary fibers disclosed elsewhere herein. For example, an ejector for secondary fiber may be oriented so that it moves around or back and forth over the stream of primary fiber. Or, the stream of primary fiber may be directed onto a continuous belt. In this and any other embodiment, a movable flat surface could be part of a continuous belt system that feeds the fibrous material into rolls or into other processing systems. The fiber may be oriented into a linear stream or streams of generally parallel fibers by directional airflow and used in a manner like other streams or structures for primary fibers disclosed elsewhere herein. For example, an ejector for secondary fiber may be oriented so that it moves around or back and forth the longitudinal axis of primary fibers collected in a linear or parallel fashion on a conveyor belt or spooling apparatus. Or, the stream of primary fiber may be directed onto a continuous belt. A secondary fiber stream of melted, softened, or solid material may be laid over the primary fiber, which may be in a melted, softened or solid form on the belt. The composite structure may be fed into compression set rollers. The rollers may be heated to facilitate the fusion bonding of the primary and secondary fibers.

A secondary fiber stream of melted, softened, or solid material may be laid over a primary fiber, which may be in a melted, softened or solid form on the belt or another collector as with other methods disclosed herein. The composite structure may be fed into compression set rollers. The rollers may be heated to facilitate the fusion bonding of the primary and secondary fibers.

Figure 1B:
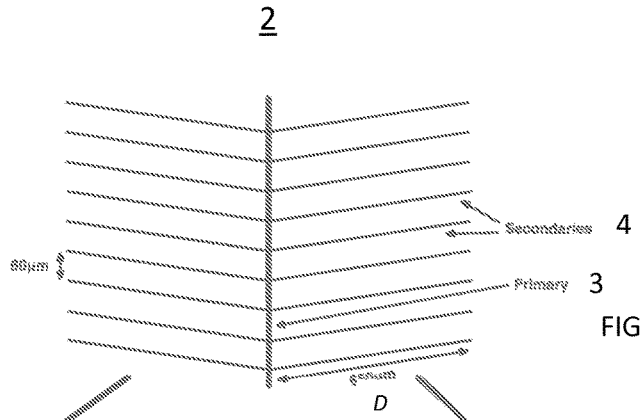
FIG. 1B schematically illustrates a natural down cluster, showing primary and secondary structures.

In any given system for production of a composite fiber, the secondary fiber 114 may be positioned and set in a transverse pattern over the primary fiber 112 in a non-loop form. For example, linear or curved segments of secondary fiber may be laid over and bonded to the primary fiber by creating a discontinuous stream of secondary fiber. This can be achieved by providing bursts of secondary fiber material from ejectors instead of continuous streams. This would have the effect of creating short segments of secondary fiber that cross-over the primary fiber with free end points on other side of the crossover point, like that for the secondary structures of natural down shown in FIG. 1B. Alternatively or additionally, directed air or gas flow may be used to break up continuous streams or to create curvatures in segments of secondary fiber material as it is positioned on the primary fiber structure.

In a given system, the diameters and/or shapes or dimensions of the outlet ports for the ejectors may be uniform or they may be varied. In some embodiments the outlet ports are formed as nozzles of a predetermined length that have decreasing taper toward the port. Outlet ports for ejectors and associated passages or channels may be formed using known micromilling techniques, or to be discovered techniques. Known techniques include mechanical millings, chemical etching, and laser drilling and ablation.

In addition to superfine fibers, forcespinning systems according to the inventive subject matter may be used to create fibers of standard textile size (e.g., 50-150 denier).

The fibers in any of the embodiments may include functional particles such as, but not limited to, antimicrobials, metals, flame retardants, anti-static, water repellents and ceramics. These materials may be introduced into the fiber-forming material. They may bond to the material covalently, by hydrogen bonds, ionic bonds or van der Waals forces, for example. A catalyst may be included in the material mixture to facilitate any such bonding.

In certain embodiments of the inventive subject matter, the flowable, fiber-forming material may be a mixture of two or more polymers and/or two or more copolymers. In other embodiments, the fiber-forming material polymers may be a mixture of one or more polymers and or more copolymers. In other embodiments, the fiber-forming material may be a mixture of one or more synthetic polymers and one or more naturally occurring polymers.

In some embodiments according to the inventive subject matter, the fiber-forming material is fed into a reservoir as a polymer solution, i.e., a polymer dissolved in an appropriate solution. In this embodiment, the methods may further comprise dissolving the polymer in a solvent prior to feeding the polymer into the reservoir. In other embodiments, the polymer is fed into the reservoir as a polymer melt. In such embodiment, the reservoir is heated at a temperature suitable for melting the polymer, e.g., is heated at a temperature of about 100° C. to about 300° C.

In some embodiments according to the inventive subject matter, a plurality of micron, submicron or nanometer dimension polymeric fibers are formed. The plurality of micron, submicron or nanometer dimension polymeric fibers may be of the same diameter or of different diameters.

In some embodiments according to the inventive subject matter, the methods of the invention result in the fabrication of micron, submicron or nanometer dimensions. For example, it is believed possible to fabricate polymeric fibers having diameters (or similar cross-sectional dimension for non-circular shapes) of about 15, 20, 25, 30, 35, 40, 45, 50, 55, 60, 65, 70, 75, 80, 85, 90, 95, 100, 110, 120, 130, 140, 150, 160, 170, 180, 190, 200, 210, 220, 230, 240, 250, 260, 270, 280, 290, 300, 310, 320, 33, 340, 350, 360, 370, 380, 390, 400, 410, 420, 430, 440, 450, 460, 470, 480, 490, 500, 510, 520, 530, 540, 550, 560, 570, 580, 590, 600, 610, 620, 630, 640, 650, 660, 670, 680, 690, 700, 710, 720, 730, 740, 750, 760, 770, 780, 790, 800, 810, 820, 830, 840, 850, 860, 870, 880, 890, 900, 910, 920, 930, 940, 950, 960, 970, 980, 990, 1000 nanometers, or 0.5, 1, 2, 5, 10, 20, 30, 40, 50, 60, 70, 80, 90, 100 or more micrometers. Sizes and ranges intermediate to the recited diameters are also part of the inventive subject matter.

The polymeric fibers formed using the methods and devices of the invention may be of a range of lengths based on aspect ratios of equal to or greater than 1, 10, 20, 30, 40, 50, 60, 70, 80, 90, 100, 500, 1000, 5000 or higher relative to the foregoing fiber diameters. In one embodiment, the length of the polymeric fibers is dependent at least in part, on the length of time the device is rotated or oscillated and/or the amount of polymer fed into the system. For example, it is believed that the polymeric fibers may be formed having lengths before or after segmentation of at least 0.5 micrometer, including lengths in the range of about 0.5 micrometers to 10 meters, or more. Additionally, the polymeric fibers may be cut to a desired length using any suitable instrument. Sizes and ranges intermediate to the recited lengths are also part of the inventive subject matter.

A wide variety of materials (synthetic, natural, bio-based-plants, bio-based-fermented) and fabric/substrate types (knits, wovens, and nonwovens) are contemplated for use in end products. Non-limiting examples of superfine fibers that may be created using methods and apparatuses as discussed herein include natural and synthetic polymers, polymer blends, and other fiber-forming materials. Polymers and other fiber-forming materials may include biomaterials (e.g., biodegradable and bioreabsorbable materials, plant-based biopolymers, bio-based fermented polymers), metals, metallic alloys, ceramics, composites and carbon superfine fibers. Non-limiting examples of specific superfine fibers made using methods and apparatuses as discussed herein include polytetrafluoroethlyene (PTFE), polypropylene (PP), polyurethanes (PU), nylon, bismuth, and beta-lactam superfine fibers.

Superfine fiber collections may include a blending of multiple materials, as indicated above. Superfine fibers may also include single or multiple lumens. They may also have surface features such as pits or pores. Multi-lumen superfine fibers may be achieved by designing, for example, one or more outlet ports with concentric openings. In certain embodiments, such openings may comprise split openings (i.e. an opening that possesses one or more dividers such that two or more smaller openings are made). Such features may be utilized to attain specific physical properties. For instance, the fibers may be produced for use as thermal insulation, such as in the insulation applications described below, or for use as elastic (resilience) or inelastic force attenuators.

In certain embodiments, fibrous webs of the present disclosure may include elastic fibers, such as polyurethane and polyacrylate based polymers, to impart stretchability to the nonwoven textiles made according to the inventive subject matter.

In contrast to the prior art, superfine fibers according to the stream extrusion teachings herein may be used to achieve improved performance based on the superfine fiber diameters and/or use of nanotubes or other structures that increase volume of entrapped air per a given unit of density of insulative material. The superfine fibers may be blended with larger diameter fibers that provide strength or durability to the blended construct of fibers.

The fibers in a construct of insulative materials may be of substantially the same deniers or they may be a blend of deniers. In either case, a suitable range for many applications is 1-6 denier or thereabout. In apparel applications, a suitable range may be 1-3 denier or thereabout.

In any of the foregoing embodiments, streams of directionally controlled or pulsed air or other gas could be used to help draw the secondary fiber and arrange it on the primary fiber. Heating of the streams may facilitate the drawing and bonding process. The one or more exit ports for the gas may be disposed at desired positions adjacent an exit port for the fiber-forming material. The gas exit port may also be in the nature of a whole or partial ring around the exit port of the flowable material.

The extruded or ejected or drawn composite structures of filamentous materials created by any of the processes contemplated herein may be cut, broken, severed, and otherwise segmented to desired, staple lengths. The fibers may be segmented by mechanical cutting means, laser energy, thermal energy, ultrasonic energy, and any other known or to be discovered ways of segmentation of physical structures. An example of mechanical cutting includes a simple guillotine or rotary cutting blade, as is well known in the industry to produce short lengths of cut staple fiber. Suitable lengths may be from 0.1 mm-5 cm or thereabout, as well as other lengths contemplated elsewhere herein. Suitable lengths to mimic natural down primary structures are from 5 mm-70 mm or thereabout, or 3-33 mm or thereabout, or 14 mm-20 mm or thereabout, as indicated elsewhere. If the segments are too small, the fibers may not loft. If they are too long, they may permanently entangle.

Just as secondary fibers may be disposed in spaced relation along any primary fiber, tertiary fibers may be disposed in spaced relation along any secondary fiber. For example, the principles disclosed above for creating secondary fibers on primary fibers may be applied to first creating filamentous composites of secondary and tertiary fibers in the same or different relative dimensional ratios as for the primary and secondary fibers. For example, the dimensions of the tertiary structures could mimic those of natural down. The filamentous material could be collected and streamed in softened or solid phase over a primary structure using techniques disclosed and contemplated herein. The tertiary fibers could be made using the same materials as for the primary or secondary fibers.

The initial composite structures formed by fibers 112 and 114 may have indefinite lengths based on forming the primary fiber in a continuous processing operation. The lengths may be from a few micrometers range to the hundreds of meters or more. The loops 16 may have maxima that extend from 100 μm-1000 μm or thereabout from the primary structure. Lengths of 300 μm-1000 μm or thereabout may mimic natural down's length of 600 μm-700 μm or thereabout. If the loops are too short, they may not allow for good separation of the primary fibers. If the loops are too long, they may entangle. The secondary fiber intersection points with the primary fiber may have spacings between 10 μm to 150 μm. Spacings of 40 μm-80 μm or thereabout may mimic natural down's spacing of 60 μm or thereabout.

(All measurements assume that the corresponding dimension is measured by traveling along the path of the applicable structure, For example, if a primary structure has a curving path, the length is measured not in a straight line from one end point to another but by traveling along the curved path. This, of course, is the same distance that would be measured if the curved structure were straightened.)

The following describes one of many possible embodiments, but is directed to units of synthetic down that are intended to closely mimic some or all features of natural down. As noted, the secondary fiber does not need to be neatly arranged on the primary fiber. One notable parameter is the length ratio of primary fiber to secondary fiber. This ratio should preferably be 20:1 or thereabout, and in any case between 4:1 or thereabout and 100:1 or thereabout. One possible embodiment, which closely mimics several natural down properties, has about a 20 μm-30 μm diameter primary fibers; about 1 μm-20 μm secondary fiber diameter, and about a 20:1 primary fiber to secondary fiber length ratio. The average spacing of the secondary fibers on the primary fibers is about 60 μm (although this will vary from fiber to fiber with random variation in the meltblowing process or other production process). A notable feature is that the secondary fibers are arranged transversely to the primary fiber. In some embodiments, the secondary fibers may be arranged substantially perpendicular to the primary (as opposed to a conventional yarn in which the fibers are substantially parallel to the yarn, with a small offset, and twisted. In another possible embodiment, due to the nature of forcespinning, the secondary fiber could wrap directly around the primary fiber after extrusion and before laydown.

In one possible embodiment, the spinneret can have multiple orifices where each orifice can has a different diameter to create a range of nanofibers and micron size fibers on the same spinneret. The orifices can be arranged in the same plane or out of plane to facilitate the wrapping of different smaller fibers around larger fibers during the rotation of the spinneret. The overall composite structure of the units of primary and secondary fibers should have a low density of equal to or less than 1% or thereabout of the filling volume.

Polyester filaments are an example starting material for producing the fill material structures disclosed or contemplated herein, particularly those that are intended to mimic natural down. Other synthetic or natural materials for one or both of the primary and secondary structures include: polyester (ethylene terephthalate), polyolefins (polypropylene and polyethylene, or their co-polymers). The materials could also be any other synthetic fiber that is presently used in meltblowing (or electrospinning if an electrospinning process is used). Examples include: other polyesters, e.g. poly (trimethylene terephthalate) (Sorona™), polyamides (e.g. Nylon), poly(methyl methacrylate) (Acrylic), poly (acrylonitrile),ethylene acrylic copolymers, polystyrene, polytetrafluroethylene (PTFE), ethylenechlorotrifuoroethylene (ECTFE), polyurethanes, polycarbonates, pitch, and blends of two or more of the above. As noted, the primary and secondary fibers might be made from different materials, but polyester is one example of a suitable material for both.

For some performance insulation applications, factors affecting fiber selection may include:

- Young's modulus—should be much higher than ~10 MPa
- Yield strain—should be as high as possible, at least 1%, and preferably more than 10%
- Coefficient of friction should ideally be anisotropic, in that when the insulation is compressed the friction should be high, and when allowed to re-loft the friction should be low (down achieves this using its tertiary structures)
- Hydrophobic fibers are highly preferred to make the insulation resistant to moisture
- As well as surface hydrophobicity, the fibers should be generally resistant to moisture, and their mechanical properties should not change when wet
- Low bulk density of equal to or less than 30 kg/m$^3$ or thereabout once the yarns are filled into a compartment. Natural down is about 10 kg/m3, once packed into a compartment. Heavier insulation of 20-30 kg/m$^3$ or thereabouts is a specific range that is within the scope of the invention. (The bulk density of individual, unpacked yarns may not be a meaningful number in itself, as they may be a planar structure, and they may interpenetrate to some degree when they are packed into a compartment, and with a sufficiently low bulk density that the fiber units may avoid entangling with themselves.)

The fill power of natural goose down is an indicator of two important features: warmth-to-weight ratio and compressibility, both critical to retain warmth and furnish comfort. True fill power is measured by placing one ounce of goose down in a graduated cylinder and measuring the volume the down occupies in cubic inches. It is believed that the insulative materials made according to embodiments of the inventive subject matter are capable of rivaling goose down and providing 550 to 900 fill power, or thereabout, similar to goose down.

Figure 16:
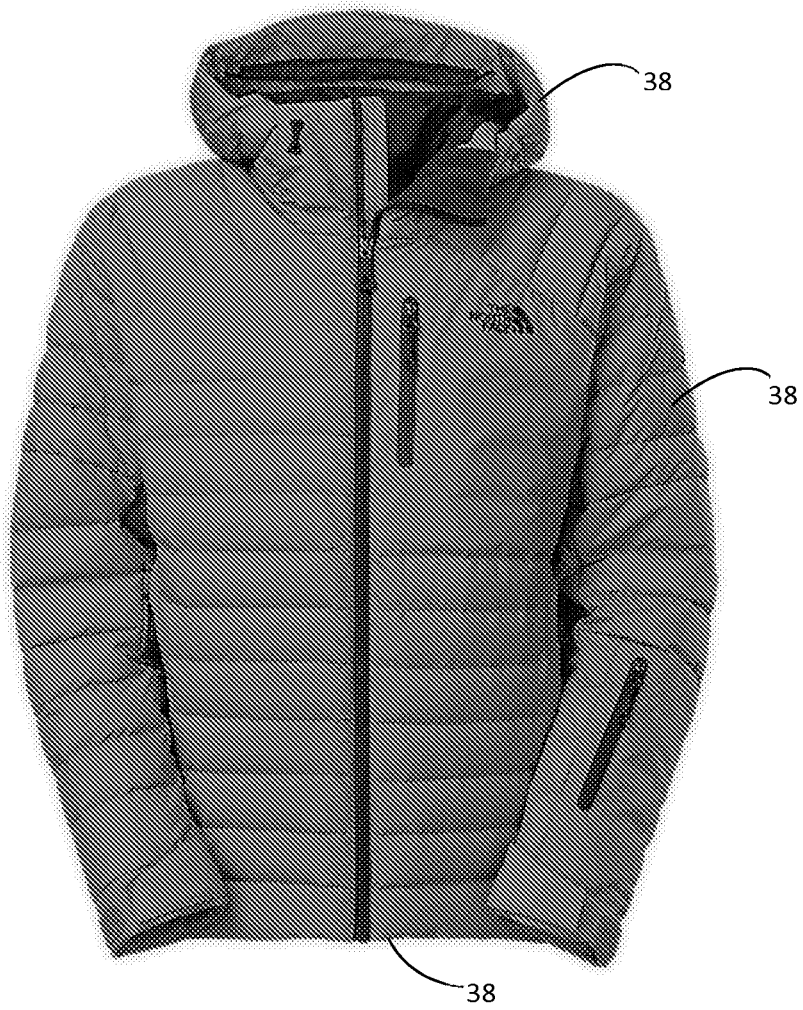
FIG. 16 schematically illustrates a finished product (in this case a jacket) with compartments holding a bulk fill material consisting of units of synthetic constructs that mimic natural down.

The inventive subject matter is particularly directed to certain articles incorporating the insulation units. The articles include any range of articles where such insulation material may be used, including in garments and apparel, e.g., insulated jackets and pants; footwear, e.g., shoes and socks; headwear, e.g., parka hoods and other insulated hats, and facemasks; outdoor equipment, e.g., sleeping bags and shells for sleeping bags, blankets, tents, tarps and other covers; bedding, pillows, cushions, upholstery, etc. In general, such products consist of a predetermined amount of fill material enclosed within a woven or nonwoven or knitted textile or fabric in a sealed compartment that has a plurality of walls that are sealed through stitching, knitting, weaving, gluing, taping, fusion bonded, or other known or discovered means of sealing textile or fabric materials. FIG. 16 shows a representative product, namely a parka 36 with a plurality of compartments 38 throughout the body, extremity and hood portions filled with insulative constructs according to the inventive subject matter. The garment may have a compartment with an outer-facing wall that is a durable material, e.g. ripstop (e.g., Cordura™) nylon, and an inner wall (body facing) that is a finer or more comfortable material, such as polyester, fleece, cotton, or merino wool. Another layer may be laminated to the outer and/or inner layers. For example, a barrier layer of a waterproof, breathable membrane material such as expanded PTFE (e.g., Gore-Tex brand PTFE) may be laminated to the inner or outer layer. Other possible layers include hydrophilic layers to wick moisture or other functional layers. Any wall or layer may also be made using elastic materials such as elastane or polyurethane yarns.

Persons skilled in the art will recognize that many modifications and variations are possible in the details, materials, and arrangements of the parts and actions which have been described and illustrated in order to explain the nature of the inventive subject matter, and that such modifications and variations do not depart from the spirit and scope of the teachings and claims contained therein.

All patent and non-patent literature cited herein is hereby incorporated by references in its entirety for all purposes.

As used herein, "and/or" means "and" or "or", as well as "and" and "or." Moreover, any and all patent and non-patent literature cited herein is hereby incorporated by references in its entirety for all purposes.

The principles described above in connection with any particular example can be combined with the principles described in connection with any one or more of the other examples. Accordingly, this detailed description shall not be construed in a limiting sense, and following a review of this disclosure, those of ordinary skill in the art will appreciate the wide variety of lending systems and other systems that can be devised using the various concepts described herein. Moreover, those of ordinary skill in the art will appreciate that the exemplary embodiments disclosed herein can be adapted to various configurations without departing from the disclosed principles.

The previous description of the disclosed embodiments is provided to enable any person skilled in the art to make or use the disclosed innovations. Various modifications to those embodiments will be readily apparent to those skilled in the art, and the generic principles defined herein may be applied to other embodiments without departing from the spirit or scope of this disclosure. Thus, the claimed inventions are not intended to be limited to the embodiments shown herein, but are to be accorded the full scope consistent with the language of the claims, wherein reference to an element in the singular, such as by use of the article "a" or "an" is not intended to mean "one and only one" unless specifically so stated, but rather "one or more".

All structural and functional equivalents to the elements of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim element is to be construed as "a means plus function" claim under US patent law, unless the element is expressly recited using the phrase "means for" or "step for".

The invention claimed is:

1. A bulk fill material, comprising a plurality of fiber constructs, each construct having a configuration comprising:

a primary fiber having a predetermined length; and a second fiber structure, the secondary fiber structure comprising a plurality of loops, each loop consisting of a single monofilament fiber and having a pair of spaced apart intersection points with the primary fiber, wherein each of the intersection points of the primary fiber and the single monofilament fiber is spaced apart a length of the primary fiber from the other intersection points of the primary fiber and the single monofilament fiber, the primary fiber and the secondary fiber structure being coupled together at the intersection points by bonding of materials;

wherein the primary fiber has a length of 0.1 mm to 5 cm.

2. The bulk fill material of claim 1 wherein the primary fiber length is between 5 mm to 70 mm.

3. The bulk fill material of claim 1 wherein the secondary fiber has more than 20 loops.

4. The bulk fill material of claim 3 wherein the secondary fiber intersection points with the primary fiber are spaced from 10 μm to 150 μm apart.

5. The bulk fill material of claim 1 wherein the secondary fiber loops have a maxima of 5 mm or less.

6. The bulk fill material of claim 3 wherein the secondary fiber loops have a maxima of between 100 μm to 1 mm.

7. The bulk fill material of claim 3 wherein the secondary fiber loops have a maxima of between 300 μm-1000 μm.

8. The bulk fill material of claim 1 wherein the primary fiber has a diameter equal to or less than 100 μm.

9. The bulk fill material of claim 1 wherein one or both the primary fiber and secondary fiber structure comprise a thermoplastic material, the thermoplastic material of one or both of the primary fiber and secondary fiber structure being fused to the material of the other of the primary fiber and/or secondary fiber structure to provide the bonding of materials, the primary fibers and secondary fiber structures in a given fiber construct forming a monolithic structure.

10. The bulk fill material of claim 1 wherein the primary fiber and/or secondary fiber structure comprises a hollow fiber.

11. The bulk fill material of claim 1 wherein the secondary fiber loops are in a pattern comprising a generally sinusoidal pattern, with the primary fiber comprising a base line for the sinusoidal pattern.

12. The bulk fill material of claim 3 wherein the secondary fiber loops are disposed in multiple planes in a twisting or helical arrangement around the primary fiber.

13. The bulk fill material of claim 3 wherein the secondary fiber loops comprise a continuous strand of secondary material fusion bonded to the primary fiber to form a monolithic structure, and wherein the primary fibers have higher stiffness, tensile strength, and/or higher thickness relative to the secondary fibers.

14. The bulk fill material of claim 1 wherein a given secondary fiber loop is disposed in multiple planes with the primary fiber.

15. A bulk fill material comprising a plurality of fiber constructs according to claim 1, the plurality of such constructs having a bulk density of about 50 kg/m$^3$ or less.

16. A method of making a fiber construct, comprising:

ejecting from a first ejector a stream of melted or softened fiber-forming material for a secondary fiber in a predetermined pattern onto a stream or structure for a primary fiber so as to create a composite fiber structure of primary fiber and secondary fiber, and wherein in the predetermined pattern, the secondary fiber is disposed on the primary fiber in a plurality of loops, each loop consisting of a single monofilament fiber and having a pair of spaced apart intersection points with the primary fiber, wherein each of the intersection points of the primary fiber and the single monofilament fiber is spaced apart along a length of the primary fiber from the other intersection points of the primary fiber and the single monofilament fiber, the primary fiber and the secondary fiber structure being coupled together at the intersection points by bonding of materials; and segmenting the primary fiber lengths into a plurality of smaller units of constructs wherein the average length of the segmented primary fiber is between 0.1 mm to 5 cm.

17. The segmented fiber constructs of claim 16 wherein on the average the segmented primary fibers have more than 20 loops each.

18. The method of claim 16 wherein the secondary fiber material is compression set onto the primary fiber material.

19. A bulk fill material comprising a plurality of fiber constructs:

the plurality of such constructs having a bulk density of about 50 kg/m$^3$ or less, wherein the plurality of constructs provide a fill power of 550 to 1000, and wherein each fiber construct comprises, a primary fiber structure comprising a predetermined length of fiber; and a secondary fiber structure, the secondary fiber structure comprising a plurality of loops, each loop consisting of a single monofilament fiber and having a pair of spaced apart intersection points with the primary fiber, wherein each of the intersection points of the primary fiber and the single monofilament fiber is spaced apart along a length of the primary fiber from the other intersection points of the primary fiber and the single monofilament fiber, the primary fiber structure and the secondary fiber structure being coupled together at the intersection points by bonding of materials, free of mechanical fasteners, and wherein the primary fiber has more than 20 loops, and wherein the secondary fiber intersection points with the primary fiber are spaced from 10 μm to 150 μm apart and wherein the secondary fiber loops have a maxima of between 100 μm to 1 mm.

20. The method of claim 16 comprising: ejecting the secondary fiber material in a back and forth pattern onto the stream or structure for the primary fiber material.

21. The method of claim 16 comprising: ejecting the secondary fiber material in a partially encircling or fully encircling pattern onto the stream or structure for the primary fiber material.

22. The bulk fill material of claim 1 wherein the monofilament fiber has a diameter equal to or less than 100 μm.

23. The bulk fill material of claim 1 wherein the monofilament fiber has a diameter between 1 μm to 3 μm.

24. The bulk fill material of claim 1 wherein the loops of the secondary fiber are oriented along a same side of the primary fiber.

* * * * *